United States Patent [19]

Marette

[11] Patent Number: 4,782,750

[45] Date of Patent: Nov. 8, 1988

[54] PRINTING MACHINE FOR ARTICLES WITH NONCIRCULAR CONVEX SURFACES

[75] Inventor: Gilles Marette, Coulommiers, France

[73] Assignee: Societe d'Exploitation des Machines Dubuit, Noisy-le-Grand, France

[21] Appl. No.: 85,712

[22] Filed: Aug. 17, 1987

[30] Foreign Application Priority Data

Aug. 18, 1986 [FR] France ..... 86 11800

[51] Int. Cl.[4] ..... B41F 17/22

[52] U.S. Cl. ..... 101/39; 101/8; 101/124

[58] Field of Search ..... 101/124, 123, 126, 38 R, 101/38 A, 39, 40, 27, 5, 7, 8

[56] References Cited

U.S. PATENT DOCUMENTS

| | | | |
|---|---|---|---|
| 3,249,043 | 5/1966 | Karlyn | 101/38 |
| 3,249,045 | 5/1966 | Karlyn | 101/124 X |
| 3,260,194 | 7/1966 | Karlyn | 101/38 |
| 4,469,022 | 9/1984 | Meador | 101/38 |

FOREIGN PATENT DOCUMENTS

| | | | |
|---|---|---|---|
| 63390 | 10/1982 | European Pat. Off. | 101/123 |
| 2314831 | 3/1982 | France . | |
| 87986 | 6/1982 | Japan | 101/126 |
| 1183782 | 3/1970 | United Kingdom | 101/40 |

*Primary Examiner*—Clifford D. Crowder

*Attorney, Agent, or Firm*—Charles E. Brown; Charles A. Brown

[57] ABSTRACT

A machine for printing oval objects. The oval object has imparted to it a simple pivoting movement about an axis which is separate from the center of the radius of curvature of a section of the area of the object to be screenprinted upon. The printing screen which is attached to a printing or a screen support is moveable to correct simultaneously the distance between the screen and the rotation axis of the object. The printing machine is applicable to processes for decorating convex surfaces by screen printing, hot pressing, and dry offset printing.

12 Claims, 4 Drawing Sheets

PRINTING MACHINE FOR ARTICLES WITH NONCIRCULAR CONVEX SURFACES

The invention relates to a printing machine for printing a convex surface, notably on three-dimensional objects; it is more particularly concerned with a new arrangement enabling screenprinting of cylindrical objects with non-circular convex cross-sections.

A screenprinting machine comprises a frame within which is stretched the printing screen and an inking spatula or scraper which is moved over the surface of the screen to apply the ink through the mesh of said screen to an object in contact with the other side of the screen.

If the surface of the object is not flat it is necessary to bring about relative movement between the latter and the screen so that the area to be screenprinted rolls without slipping on the surface of the screen.

If the object to be screenprinted is cylindrical with a circular cross-section, for example, the mechanism is relatively simple and in particular the movement which has to be imparted to said object reduces to simple rotation about the axis of the area to be screenprinted.

On the other hand, if the object to be screenprinted is cylindrical but has any other convex cross-section, usually called oval, the mechanism is more complex since the rotation of the object is then accompanied by a displacement of it relative to the plane of the screen.

Known mechanical solutions to this problem are therefore complicated and relatively costly.

In particular, in an automatic machine of this type the conveyor means which offer up an object facing the screen are complicated notably by the fact that the position of the support for the object varies.

An object of the invention is to propose a simpler and less costly mechanism for printing on a convex surface.

The basic idea of the invention consists in simplifying the movement to be imparted to the object by making variable the distance between, on the one hand, the printing screen or, more generally, the flat printing means employed in the case where some other printing process is used, and, on the other hand, the axis of rotation of the object.

More precisely, an object of the invention is a printing machine for printing on at least one convex substantially cylindrical area of the surface of a three-dimensional object, of the type comprising a mobile assembly adapted to carry a flat printing means, such as a silk-screen, for example, and mean for causing said object to pivot in such a way that said area remains substantially in the plane of said printing means, characterized in that it comprises means for making said object pivot on itself about an axis fixed in position, that is to say about an axis of rotation the position of which relative to the frame is fixed, and means for simultaneously correcting the distance between said printing means and the rotation axis of said object and such that said printing means remains parallel to itself.

In a first embodiment that can be envisaged the means for correcting the distance between the printing means and the rotation axis of the object result from the fact that, in the same way as a deformable parallelogram, the mobile assembly carrying the printing means is pivotally mounted between two mechanisms comprising links of equal length pivoting about respective and in practice horizontal shafts.

In a second embodiment that can be envisaged the mobile assembly is mounted to move perpendicularly to the plane of the printing means and, by means of an upright itself mounted to be movable parallel to this plane, it is articulated to a handle keyed to rotate with the means adapted to cause the object to be printed to pivot about a fixed rotation axis.

In both cases, and in addition to the longitudinal displacement necessary for a printing operation, the screen or other printing means employed conjointly has imparted to it, by virtue of the mobile assembly that carries it, a displacement transverse to the former which moves it progressively nearer the rotation axis of the object during printing and then moves it away therefrom, which procures the required correction of the distance between the printing means and the object.

However, in accordance with an important characteristic of the invention, the axis about which the object rotates during printing is advantageously fixed relative to the frame.

The result of this is an advantageous simplification in the structure and, notably, an advantageous simplification of the conveyor means needed for feeding the objects to be printed automatically one by one to the printing station.

Also, and in particular in the case of screenprinting, the printing machine in accordance with the invention advantageously lends itself to easy adaptation to printing on cylindrical objects having convex cross-sections with different radii of curvature, to printing on cylindrical objects of circular cross-section and to printing on flat objects.

In accordance with a complementary characteristic of the invention, the mobile assembly employed comprises a guide on which the support for the printing means is slidably mounted, the means for causing the object to be printed to pivot on itself comprise elements for holding the object mounted to rotate about an axis parallel to the cylindrical area to be printed on the object, and said printing means support is constrained to follow the contour of a pivoting element featuring a curvature and a pivot axis representative of the curvature and the pivot axis of said cylindrical area to be printed of said object.

For each object to be printed, whether it is a cylindrical object with a non-circular convex cross-section or a cylindrical object with a circular cross-section, it is then merely necessary to choose appropriately the pivoting element to be employed, in practise a gearwheel or part of a gearwheel, and to carry out the necessary adjustments.

The invention will be better understood and other advantages of it will emerge more clearly from the following description by way of example with reference to the appended drawings in which.

Figure 1:
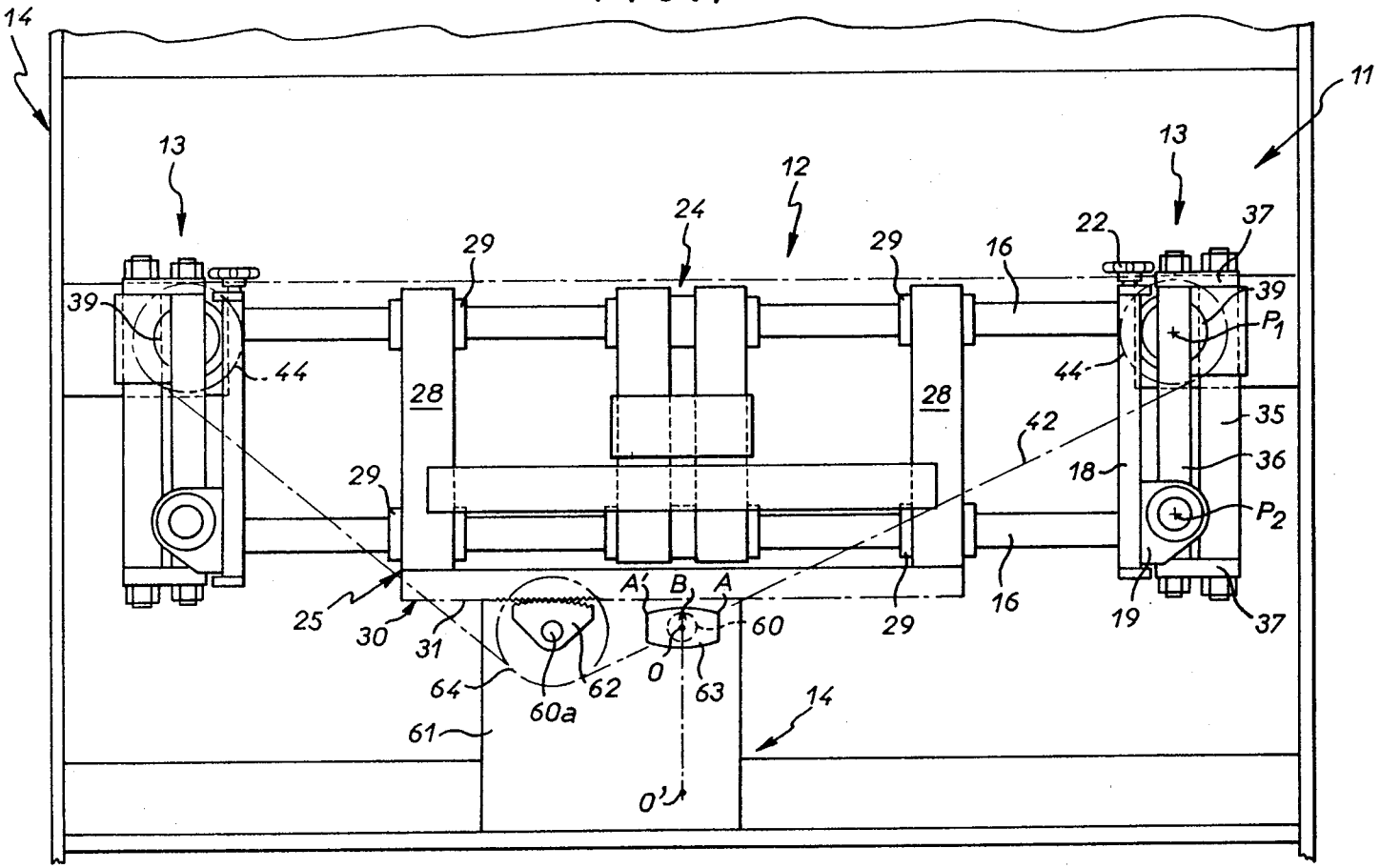
FIG. 1 is a schematic view in elevation of a screenprinting machine in accordance with the invention.
Figure 2:
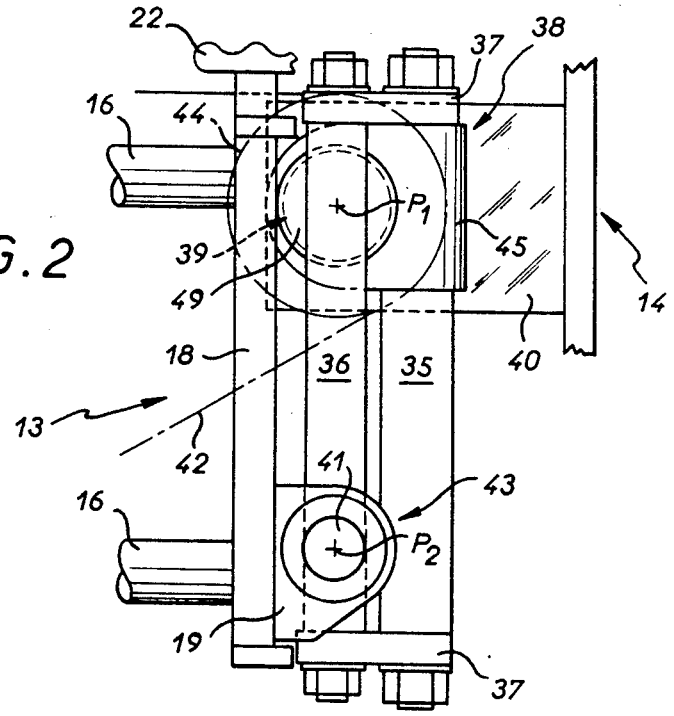
FIG. 2 is a detail view in elevation and to a larger scale of one of the link-forming mechanisms that this printing machine comprises.
Figure 4:
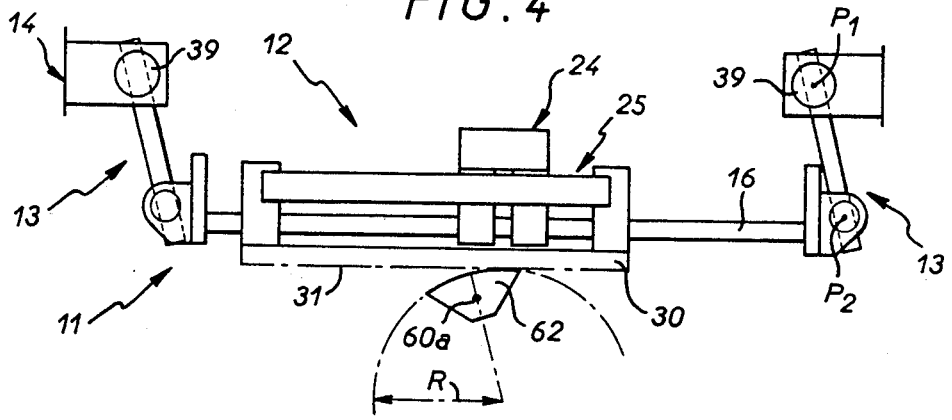
Figure 5:
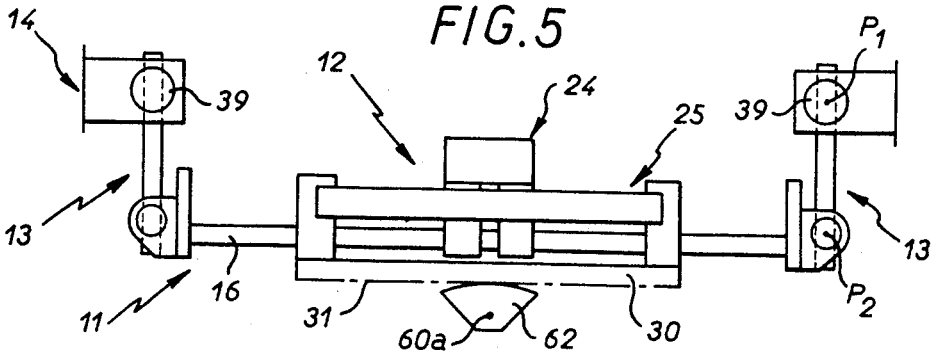
Figure 6:
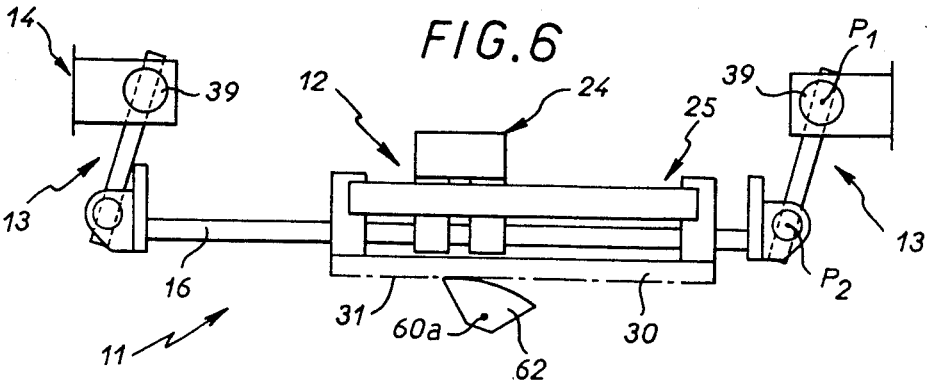
Figure 7:
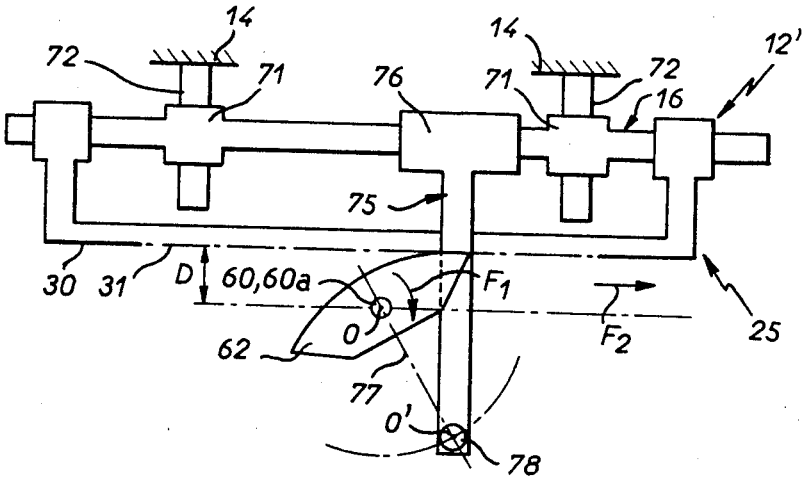
Figure 8:
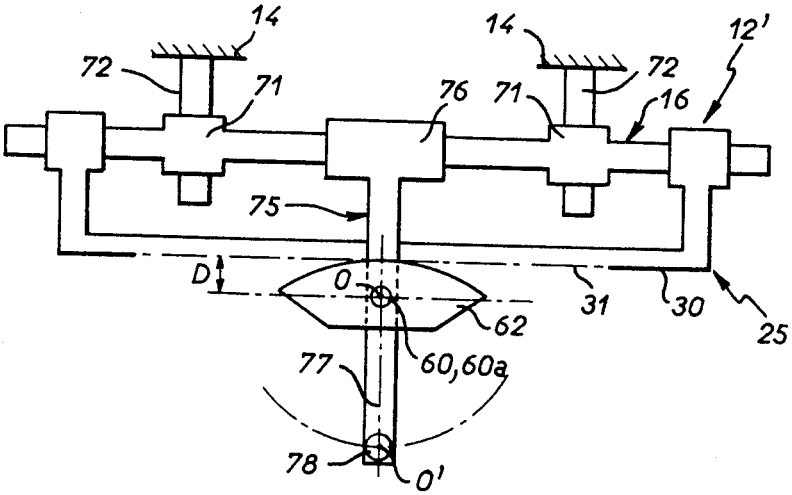
Figure 9:
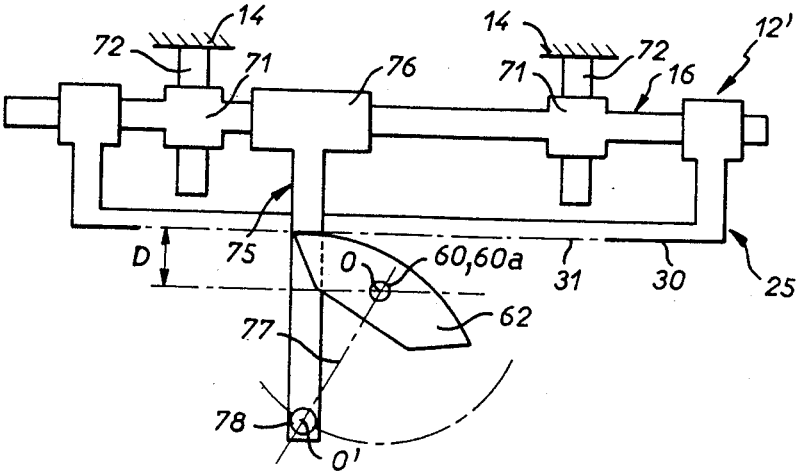

FIGS. 4 through 6 are schematic views analogous to that of FIG. 1 showing the functioning of the printing machine concerned; and FIGS. 7 through 9 are schematic views respectively analogous to those of FIGS. 4 through 6 relating to another embodiment.

In the embodiment shown in FIGS. 1 through 6, the screenprinting machine 11 in accordance with the invention comprises a mobile assembly 12 pivotally mounted between two link-forming mechanisms 13 which pivot relative to the frame 14 of the machine. The mobile assembly 12 comprises a sort of support frame comprising two parallel and in this instance horizontal slideway shafts 16 and two and in this instance vertical uprights 18 forming lockable sliders.

The uprights 18 are supported by yokes 19 articulated to respective link-forming mechanisms 13. The position of the yokes 19 along the length of the uprights 18 may be adjusted. More precisely, a nut-and-bolt system operated by a crank 22 forms the coupling between each upright 18 and the corresponding yoke 19, the latter carrying the corresponding nut. The nut-and-bolt system is operated from the upper part of each upright 18 by a crank 22 aligned with the corresponding bolt. The two nut-and-bolt systems of the two parallel uprights 18 are coupled together by a chain coupling (not shown).

The two shafts 16 carry a scraper or doctor blade support 24 and a screen support 25. The scraper and the printing screen fixed to the supports 24 and 25 are conventional subassemblies and are not shown to avoid overcomplicating the drawings.

In the application envisaged, consisting in screenprinting "oval" cylindrical surfaces, the scraper support 24 is fixed to the shafts 16 whereas the screen support 25 is able to slide along them; these shafts therefore form a guide for the screen support 25.

In the embodiment shown, the screen support 25 is generally U-shaped and comprises two vertical uprights 28 provide with rings 29 sliding on the shafts 16 and a lower horizontal crossmember 30 carrying a rack 31. Thus when, as indicated, the scraper support 24 is immobilized on the shafts 16 the screen support 25 is able to move along the shafts 16 to some distance on either side of said scraper support.

Each link-forming mechanism 13 is of adjustable operative length and comprises two parallel rods 35, 36 rigidly fastened to each other by two crossmembers 37 at their ends. A first rod 35 is clamped into a first articulation member 38 attached to a shaft 39, which is horizontal in this instance, rotatably mounted in yokes 40 fixed to the frame 14. Bearings 40*a* are disposed between the yokes 40 and the shaft 39. The combination of the two rods 35, 36 is oriented relative to the shaft 39 in such a way that the second rod 36 intersects the geometrical axis (P1) of said shaft 39 perpendicularly to the latter (see FIGS. 1 and 2). The lower end of said second rod 36 is fastened to a second articulation member 43 (FIG. 3) fixed to the mobile assembly 12 through the intermediary of the corresponding yoke 19. More precisely, said yoke 19 is articulated to a horizontal journal 41 (with axis P2) itself coupled to the second rod 36. It will therefore be understood that, when the two link-forming mechanisms 18 are adjusted in such a way that their operative length (that is to say the distance P1, P2 between the geometrical axis of the shaft 39 and of the journal 41) are the same, the mobile assembly 12 to which are fixed both the printing screen and the scraper is able to execute a controled swinging movement while remaining parallel to itself. As will be seen later, the appropriate operative length P1, P2 depends on the object to be screenprinted. The swinging movement is imparted by a chain 42 interlocked with two gearwheels 44 respectively fastened to the two shafts 39. The chain 42 is driven from a motor or an actuator by any appropriate means (through the intermediary of a cam, for example) adapted to impart to it a to-and-fro movement of the required amplitude.

Figure 3:
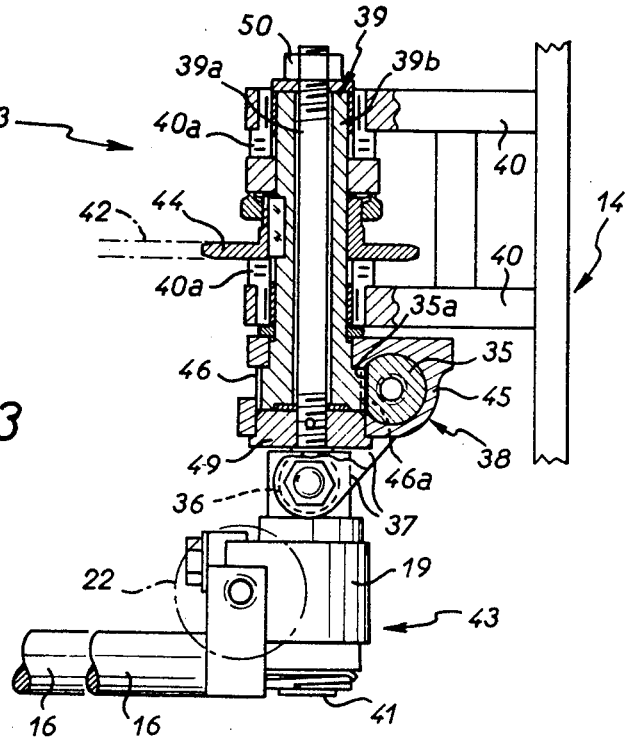
FIG. 3 is a plan view in partial cross-section of FIG. 2.

With particular reference to FIG. 3, it is seen that the first rod 35 of a link-forming mechanism 13 is fixed perpendicularly to the shaft 39 and laterally relative to the latter by elastic clamping by means of an elastically deformable member 45 forming a yoke. The shaft 39 comprises coaxial inner and outer parts 39*a*, 39*b*. The gearwheel 44 is fastened to the sleeve-shaped outer part 39*b* which carries at one end a gearwheel 46 meshing with a rack 35*a* cut along the length of said first rod 35. The inner part 39*a* is fixed to an axial abutment member 49 in contact with the part 45 forming a yoke and adapted to clamp it, for which purpose it bears against the adjacent end of the second part 39*b* of the shaft 39. To achieve this the rear end of the inner part 39*a* is threaded and receives a nut 50 bearing on the other end of the outer part 39*b*. In this way, when the nut 50 is tightened the two coaxial parts 39*a*, 39*b* and the rod 35 are fastened together rigidly in such a way that the assembly comprising the rods 35 and 36 may have a swinging movement imparted to it when the chain 42 interlocked with the gearwheel 44 has a to-and-fro movement imparted to it. On the other hand, if the nut 50 is temporarily loosened, any movement transmitted by the chain 42 results in rotation of the gearwheel 46 causing sliding of the rod 35 in the member 45 forming a yoke, which is loosened. The operative length of the link-forming mechanism 13 is adjusted in this way. As the chain 42 is interlocked with the two gearwheels 44 of the two mechanisms 13, the length is adjusted simultaneously on both sides.

The machine further comprises means for causing the object to pivot on itself about a selected axis of the object. Part of these means is visible in FIG. 1. It is a horizontal shaft 60 rotatably mounted in a fixed structure 61 of the frame 14 and carrying a base 63 shaped to receive one end of the object. The latter (not shown) may be held horizontally in alignment with this base by means of tailstock or analogous device (not shown) cooperating with a neck where the object is a bottle, for example, and if the position of the neck lends itself to this method of fixing; if this is not so, another base is provided, shaped to suit the object, facing towards the base 63 and rotatably mounted on another horizontal shaft axially aligned with the shaft 60 in such a way that the object can rotate on itself about an imaginary axis passing through it, in this instance a horizontal axis.

For convenience it will be assumed that in the example being described the convex cylindrical area of said object that is to be screenprinted has a constant cross-section perpendicular to the aforementioned imaginary axis and at this cross-section may be regarded as a circular arc A'A also shown by an edge of the base 63.

It will be understood that, in accordance with the invention, the only movement imparted to the object is a movement of rotation on itself, which greatly simplifies the mechanisms for placing and holding the objects to be screenprinted.

However, since the object is not a cylindrical object of circular cross-section its inherent rotation axis O is not conincident with the axis O' of the cylindrical area AA' to be screenprinted. The axes O and O' are shown be respective dots in FIG. 1. In practise the axis O is chosen so as to intersect, in the plane of the figure, the radius of curvature O'B passing through the center O of the corresponding arc A'A.

If the shape of the object has some unique feature facilitating holding it, the axis O is chosen according to this feature. Thus if the object is, for example, a bottle comprising a neck aligned with an axis of symmetry of the object, the axis O will preferably be coincident with this axis of symmetry.

The screen support 25 is constrained to follow the contour of a pivoting member which has a curvature and a pivot axis representative of the curvature and the pivot axis of the aforementioned convex cylindrical area, represented in the drawings by the arc A'A.

In the embodiments shown, this pivoting member is a partial gearwheel 62 (or a whole gearwheel) mounted to pivot eccentrically at the end of a horizontal shaft 60*a* parallel to the shaft 60.

This part-gearwheel 62 meshes with the rack 31.

As indicated hereinabove, its curvature and its dimensions are representative of the object to be printed and more particularly of the specific features of the surface concerned, represented here by the arc A'A of the latter. It is therefore interchangable according to the shape and the dimensions of the object. Thus in the embodiments shown the average radius of curvature R of the teeth of the part-gearwheel 62 is equal to the radius of curvature O'B, the distance from the center of rotation of the part-gearwheel 62 (the axis of the shaft 60*a*) to its teeth is equal to the distance OB, and so on.

The drive chain 42 coupling the two gearwheels 44 on the shafts 39 is passed around a gearwheel 64 fastened to the shaft 60*a*. The shafts 60 and 60*a* are coupled to rotate in the same direction by a unity ratio gear (not shown). The shafts 60 and 60*a* may be coincident, of course.

In operation, the operative length P1, P2 of the link-forming mechanisms 13 is adjusted to be substantially equal to the radius of curvature O'B of the area to be screenprinted, that is to say also to the radius of curvature R of the part-gearwheel 62. Once this adjustment has been made, the nut-and-bolt systems of the uprights 18 are operated on to bring the rack 31 into meshing engagement with the part-gearwheel 62. Operation is readily deduced from the foregoing description and is shown clearly in FIGS. 4 through 6.

At the beginning of the screenprinting operation (FIG. 4) the pivoting mobile assembly 12 carrying both the scraper support 24 and the screen support 25 is swung towards the right (as when viewing the drawings) whereas the part-gearwheel 62 is inclined as far as possible to the left without parting company with the rack 31. The screenprinting operation is effected by a swinging movement from right to left of the assembly 12 up to, firstly, an intermediate position (FIG. 5) in which the link-forming mechanisms 13 are vertical. Note that the part-gearwheel 62 has pivoted in the clockwise direction and that the screen support 25 has moved downwards at the same time as, by sliding on the shafts 16, it has moved to the right relative to the scraper support 24 which is fixed to the shafts. The movement continues (FIG. 6) until the assembly 12 completes its swinging movement from right to left and the part-gearwheel 62 completes its pivoting in the clockwise direction. During this second part of the swinging movement the screen support 25 continues to move towards the right relative to the scraper support 24 but, instead of moving downwards as previously, it moves upwards.

During all these operative phases the object has executed the same movement as the part-gearwheel 62 by rolling without slipping on the lower surface of the screen while relative movement between said screen and the scraper was occurring at the upper surface of the screen, above said object.

The machine which has just been described may be used for printing a cylindrical object of circular cross-section. In this case, all that is necessary is to lock the link-forming mechanisms 13 in the FIG. 5 position and to use a part-gearwheel 62 rotating about its geometrical axis and having the same radius of curvature as the object.

To print flat objects the screen support 25 may be immobile and the scraper support 24 released so as to impart to it a translational movement relative to the screen support 25.

In the embodiment shown in FIGS. 7 through 9, on which the same parts have been designated by the same reference numbers, the mobile assembly 12' that the printing machine in accordance with the invention comprises is mounted to move perpendicularly to the plane of the printing screen or other printing means employed and, by means of an upright 75 itself mounted to be movable perpendicularly to this plane, it is articulated to a handle 77 keyed to rotate with the means adapted to cause the object to be printed to pivot about a fixed rotation or pivot axis O.

As previously, the mobile assembly 12' comprises a guide 16 on which the corresponding screen support 25 is slidably mounted.

Also as previously, this guide 16 may be formed by two parallel shafts of which only one is visible in the figures.

In the embodiment shown the guide 16 further comprises two parallel crossmembers 71 which link the aforementioned shafts, if used, to each other and each of which forms a bush by means of which it is slidably engaged on two columns 72 perpendicular to the plane of the printing means and fastened to the frame 14 of the machine.

Thus in this instance the columns 72 are vertical.

Be this as it may, the upright 75 on which the mobile assembly 12' is articulated to the handle 77 is also mounted, by means of a sleeve 76, to slide on the guide 16.

The handle 77, shown only schematically in chain-dotted outline in the figures as its implementation will be obvious to those skilled in the art, is in practice keyed to rotate with the shaft 60 which, mounted to rotate in a fixed structure of the frame 14, carries a base shaped to receive one end of the object to be printed.

At its other end there is provided between it and the upright 75 a roller 78 adapted to procure their mutual articulation at O'.

The roller 78 is preferably adjustable in position to adjust the distance OO' according to the radius of curvature of the area of the object concerned to be printed.

For example, the roller 78 is adjustable in position by a slot-type mounting on any of the component parts of the upright 75 and the handle 77, and is interlocked with a groove provided for this purpose on the other of these members.

The scraper support associated with the screen support 25 may be fixed relative to the upright 75.

This second embodiment operates in a similar way to the first: when, pivoting on itself in the clockwise direction, for example, the object to be printed rotates about the fixed axis O, in the direction of the arrow F1 in FIG. 7, and the part-gearwheel 62 representative of it, carried by a shaft 60a and centered on the axis O', pivots in the same sense, meshing with the rack 31 carried by the bottom crossmember 30 of the screen support 25, which causes the screen support 25 to slide from left to right on the guide 16, in the direction of the arrow F2, and which conjointly causes sliding of the upright 75 on the guide 16 in the opposite direction, there occurs first of all (FIG. 7) a progressive downward movement of the mobile assembly 12' before, after passing through a bottom neutral point (FIG. 8), it moves upwards (FIG. 9).

As previously, there therefore occurs simultaneously with the movement of the screen in contact with the area to be printed of the object systematic correction of the distance D between the screen and the rotation axis O of the object.

For convenience the distance D has been shown between the axis O and the rack 31 in FIGS. 7 through 9; it goes through a minimum value for the neutral position of FIG. 8.

It will be appreciated that with this embodiment the adjustments to be made are advantageously made at a single point only, in this instance the roller 78.

It will be understood that if, as previously, for reasons of simplification, the shaft 60a carrying the part-gear-wheel 62 is shown in the figures as coincident with the shaft 60 carrying the object to be printed, in reality these shafts may be separate and parallel.

The mechanisms which have just been described are not applicable only to screenprinting. The adaptation to other printing processes employing a flat printing means such as a heated plate of a gilding press, of the kind described in French patent No 2 314 831, for example, or a blanket and plate assembly for a dry offset printing machine, and so on, is possible and obviously within the scope of the invention.

I claim:

1. A printing machine for printing on at least one noncircular, convex surface area of a three dimensional object, said printing machine comprising a mobile assembly adapted to carry a flat printing means having a general plane, means for reciprocating said printing means in a printing stroke across said area, means for pivoting the object about a fixed position rotation axis during printing such that the area remains substantially in the general plane of the printing means, mechanical means connected to said mobile assembly for transmitting movement to said printing means transversely to the general plane of said printing means and selectively towards and away from the rotation axis during printing to compensate for the noncircular surface area of the object.

2. A printing machine according to claim 1, wherein mechanical means is also conjointly adapted to transmit said printing means movement parallel to the general plane thereof in said printing stroke.

3. A printing machine according to claim 2, wherein said mechanical means comprises at least one pivoted link movable in synchronism with the means for pivoting the object.

4. Printing machine according to claim 1, wherein said mobile assembly comprises a guide for slidably mounting said printing means, said means for pivoting an object comprise members for holding the object mounted to rotate about an axis parallel to the surface area of the object, and said printing means being constrained to follow the contour of a pivoting member having a curvature and a pivot axis corresponding to the curvature and the pivot axis of said surface area of the object.

5. A printing machine according to claim 4, wherein said printing means has a rack affixed thereto and said pivoting member is a gear wheel or gear sector mounted to pivot eccentrically, and the curvature and eccentric pivot axis of the gear wheel or sector corresponding to the curvature and the pivot axis of the surface area of the object.

6. A screen printing machine according to claim 1, wherein said mobile assembly also includes a scraper support cooperable with said printing means.

7. A printing machine for printing on at least one noncircular, convex surface area of a three-dimensional object, said printing machine comprising a mobile assembly adapted to carry a flat printing means having a general plane, means for reciprocating said printing means in a printing stroke across said area, means for pivoting the object about a fixed position rotation axis during printing such that the area remains substantially in the general plane of said printing means, mechanical means for moving said printing means transversely to the general plane of said printing means for varying the distance between said printing means and the rotation axis during printing to compensate for the noncircular surface area of the object, said mechanical means for moving said printing means comprising two linkage forming links of equal length pivotable about respective parallel shafts pivotally connected to said mobile assembly.

8. A printing machine according to claim 7, wherein said mobile assembly is pivotally connected to two linkage forming links of equal length pivoting about respective parallel shafts, said printing means having a rack affixed thereto and said pivoting member being a gear wheel or gear sector mounted to pivot eccentrically, and the curvature and eccentric pivot axis of the gear wheel or sector corresponding to the curvature and the pivot axis of the surface area of the object, the operative length of the linkage forming links being substantially equal to that of the radius of curvature of the gear wheel or gear sector radius.

9. A printing machine according to claim 8, wherein the linkage forming links are of adjustable length to adapt to different gear wheel or gear sector radii.

10. A printing machine according to claim 9, wherein each linkage forming link comprises two parallel rods rigidly fastened to each other by two crossmembers at their ends, and a first one of said rods being clamped into a first articulation member rotatably mounted at the end of a corresponding one of said shafts, said rods being oriented in such a way that the second of said rods intersects the geometrical axis of said one shaft perpendicularly to said one shaft and one end of said second rod being fastened to a second articulation member fixed to said mobile assembly.

11. A printing machine for printing on at least one noncircular, convex surface area of a three-dimensional object, said printing machine comprising a mobile assembly adapted to carry a flat printing means having a general plane, means for reciprocating said printing means in a printing stroke across said area, means for pivoting the object about a fixed position rotation axis during printing such that the area remains substantially in the general plane of said printing means, mechanical means for moving said printing means transversely to the general plane of said printing means for varying the distance between said printing means and the rotation axis during printing to compensate for the noncircular surface area of the object, said mechanical means for moving said printing means comprising a crank connected between said means for pivoting the object about a fixed position and an upright, said upright being movable perpendicularly and parallel to said general plane of said printing means.

12. A printing machine according to claim 11, wherein said mobile assembly comprises a guide for slidably mounting said printing means parallel to itself, said means for pivoting an object comprising members for holding the object mounted to rotate about an axis parallel to the cylindrical surface area of the object, and said printing means being constrained to follow the contour of a pivoting member having a curvature and a pivot axis corresponding to the curvature and the pivot axis of said surface area of the object, said upright being slidably mounted on the guide.

* * * * *